US005220694A

United States Patent [19]

Knorovsky

[11] Patent Number: 5,220,694

[45] Date of Patent: Jun. 22, 1993

[54] ANCHORING DEVICE AND METHOD FOR ANCHORING A TOILET TO A BROKEN WATER CLOSET RING

[76] Inventor: Alex Knorovsky, 3809 E. Fountain St., Long Beach, Calif. 90804

[21] Appl. No.: 716,501

[22] Filed: Jun. 17, 1991

[51] Int. Cl.[5] ..... E03D 11/00

[52] U.S. Cl. ..... 4/252.4; 4/252.1

[58] Field of Search ..... 4/252.1, 252.4, 252.5, 4/252.6; 285/15, 405, 406, 407, 412, 415; 29/402.02, 402.14

[56] References Cited

U.S. PATENT DOCUMENTS 3,761,114 9/1973 Blakeley ..... 285/415 X
4,207,630 6/1980 Bressler ..... 4/252.4

FOREIGN PATENT DOCUMENTS 0004167 of 1888 United Kingdom ..... 285/412

*Primary Examiner*—William A. Cuchlinski, Jr.
*Assistant Examiner*—W. Morris Worth
*Attorney, Agent, or Firm*—Charles H. Thomas

[57] ABSTRACT

An anchoring device is provided for use in reseating a toilet atop a broken water closet ring having a circular, annular radial flange, a portion of which is missing. The boundaries of the missing portion define a gap in the flange. The anchoring device includes a pair of arcuate members, both having flat surfaces formed at the same diameter as the flange of the water closet ring and at least one of which is formed over an arc of a length greater than a semi-circle. The members have a first set of ends hingedly joined together and a second set of apertured ends which can be moved into overlapping relationship with each other. The ends of the members are drawn apart so that they may be positioned about the closet ring with their flat surfaces located directly beneath the annular radial flange of the closet ring. The apertured ends of the members are then brought together into overlapping relationship so that the members form a collar about the water closet ring with the flat surfaces of the members juxtaposed against the underside of the radial flange. The apertured ends of the members are secured together and at least one seating bolt is passed upwardly through at least one of the sets of the ends of the members for use in reseating the toilet.

13 Claims, 3 Drawing Sheets

ANCHORING DEVICE AND METHOD FOR ANCHORING A TOILET TO A BROKEN WATER CLOSET RING

BACKGROUND OF THE INVENTION

1. Field of the Invention

The present invention relates to a method and apparatus for reseating a toilet atop a water closet ring having a circular, annular radial flange, a portion of which is missing.

2. Description of the Prior Art

In the installation of toilets in residential and commercial buildings the waste disposal lines of sewage pipes terminate within the building structure in closet rings that are located at the upper extremities of the vertical terminations of the sewage lines. A closet ring includes a hollow tubular sleeve that is secured about the upper extremity of the sewage line pipe, and a circular, annular radially projecting flange or lip that extends radially outwardly from the tubular sleeve of the closet ring. A wax sealing ring is disposed atop the closet ring, and the toilet fixture is positioned atop the wax ring. Bolts are provided that extend upwardly through preformed bolt openings in the radially extending flange of the closet ring. The heads of the seating bolts bear against the underside of the closet ring flange and the shanks of the bolts extend up through the base of the toilet fixture. Retaining nuts are then threadably engaged on the seating bolt shanks so as to draw the base of the toilet bowl fixture toward the closet ring, thereby compressing the wax seal to form a liquid tight connection.

The bolt apertures in the closet ring flange are frequently formed as arcuate slots, so as to allow selective placement of bolts in different positions about the closet ring flange to accommodate the various bolt spacings in the bases of different toilet bowl fixtures.

Over time it is not at all uncommon for a portion of the closet ring flange to break off from the remaining structure of the closet ring. The flange will typically break at a bolt aperture, since the closet ring flange is weakest at the locations where these apertures are formed, and since the greatest stress is applied to the flange at the bolt apertures. When a portion of the closet ring flange breaks off in this manner, the base of the toilet is no longer firmly seated atop the closet ring. As a result, the seal against the wax ring is imperfect and the base of the toilet bowl fixture lacks stability. This leads to both an unsteadiness of the toilet bowl fixture and also leaking of water from the toilet bowl.

While closet rings can be replaced entirely, this is often a very difficult process. The closet rings are designed to form a permanent part of the plumbing installation and cannot be easily removed from the sewer line terminations to which they are attached. Consequently, various attempts have been made to devise systems for repairing broken water closet ring flanges.

One device which has been utilized is an arcuate spanning device which is described in U.S. Pat. No. 4,207,630. This device is a flat arcuately curved section of some rigid material, such as steel or hard plastic and is termed a spanner. The spanner has a central opening therein which is of a width suitable for receiving the shank of a toilet seating bolt. The spanner section is positioned at the gap defined by the missing section of the closet ring flange such that the spanner bridges the gap defined in the closet ring flange with the ends of the spanner bearing against the underside of the closet ring flange on either side of the gap. A seating bolt is disposed with its bolt head against the underside of the spanner flange and is maintained in tension by the retainer nut which bears down on the base of the toilet so as to draw the toilet base and the spanner flange together. Because the ends of the spanner bear upwardly against the remaining structure of the water closet ring flange on either side of the gap therein, the seating bolt ideally remains in tension and the wax sealing ring is maintained in a compressed condition.

As a practical matter, however, certain difficulties in the spanner flange of U.S. Pat. No. 4,207,630 arise. Specifically, the device of that prior patent provides no lateral restraint on the spanner flange. As a consequence, the spanner flange can slip or be pushed radially outwardly so that one or the other of the ends of the spanner flange no longer bears upwardly against the structure of the closet ring flange adjacent the missing section. This can occur when downward pressure is exerted on the base of the toilet fixture, thus reducing the tension on the seating bolt. With no lateral restraint the spanner flange of U.S. Pat. No. 4,207,630 can easily become dislodged from the underside of the flange ring. This is particularly true if the gap to be spanned is substantial.

Other types of water closet rings have been devised to attempt to solve the same problem. However, these other attempts have all involved specially configured water closet rings which are inordinately complex and intricate in design. Due to their complexity these water closet rings having intricate designs are expensive to fabricate and have never gained widespread commercial acceptance.

SUMMARY OF THE INVENTION

It is an object of the present invention to provide a water closet flange repair system which is simple in design yet which is highly effective in operation. In one broad aspect the invention may be considered to be an anchoring device for use with a broken water closet ring having a circular, annular radial flange, a missing portion of which defines a gap in the flange. In this aspect the invention is comprised of a pair of arcuate members both having flat surfaces formed at the same diameter as the radial flange of the water closet ring. At least one of the members is formed over an arc greater than a semi-circle.

The members of the anchoring device of the invention have a first set of ends hingedly joined together and a second set of apertured ends. The members are positionable about the closet ring with their flat surfaces located directly beneath the annular radial flange of the water closet ring. A means is provided for securing the apertured ends of the members together. This means may take the form of some interlocking arrangement or may be performed by a simple clamping mechanism, such as a clamping nut cooperating with a bolt. In any event at least one bolt is provided to extend upwardly from at least one of the sets of ends of the members and through the gap in the flange. A similar elongated seating bolt may be provided to extend upwardly through the other set of ends of the members and also through an aperture of the unbroken portion of the closet ring flange if desired. Alternatively, the undamaged portion of the closet ring flange may receive a seating bolt in a conventional manner.

Unlike prior systems, the anchoring device of the invention provides a lateral restraint on the members which are held in position beneath the flange of the water closet ring. Because one set of the ends of the members are hinged together and the other set of ends are secured to each other, the flat surfaces of the members are maintained in contact throughout with the lower surface of the undamaged portion of the water closet ring flange. Variations in tension on the seating bolts will not dislodge either of the members from an appropriate position seated against the lower surface of the undamaged portion of the closet ring flange, since the ends of the members are locked together in overlapping sets and, once fastened, cannot spread apart.

While the apertured ends of the members of the anchoring device may be formed with openings completely surrounded by the structures of the members, the apertured end of either or both of the members can also be formed with a forked extremity. In this arrangement each of the extremities of each of the members may be formed by a pair of arcuately extending fingers which define therebetween an open ended, arcuate slot.

The seating bolt that is provided as necessary part of the anchoring device has a head and a shank. The shank passes upwardly through a selected set of overlapping ends of the members. The bolt may, for example, pass upwardly through the apertured ends of the members. The means for securing the apertured ends of the members together may be comprised of the bolt head and a clamping nut. That is, with the bolt head located beneath the lowermost of the overlapping ends of the members, the shank of the bolt may extend upwardly through the apertures. The clamping nut may be threadably engaged on the shank of the bolt and tightened downwardly to clamp the apertured ends of the members tightly between the bolt head and the clamping nut. The remaining portion of the shank of the bolt extends upwardly and is adapted to receive a retaining nut for securing the base of the toilet in position.

In one embodiment of the invention the members of the anchoring device of the invention may both be formed as flat, rigid strips, each of which lies in a single, horizontal plane. The ends of the one strip reside directly atop those of the other, so that the strips reside in parallel, adjacent planes. The members are both formed in a circular arc at the diameter of the water closet ring flange. The inner edge of each arcuate member may be formed at a diameter of 145 millimeters, while the outer edge of each member may be formed at a diameter of 180 millimeters to accommodate the flanges of many of the most widely used closet rings.

In another embodiment of the invention the members are formed with a channel-shaped cross-sectional configuration and are adapted to embrace the outer periphery of the radial flange. That is, the periphery of each of the members is formed with channel or U-shaped cross section. The channel-shaped members are disposed on their sides, with the inside upwardly facing surface of each of the channel-shaped members forming the flat surface which bears against the underside of the water closet ring flange. The bases of the channel-shaped members surround the outer periphery of the water closet ring flange, and the opposing legs of each channel-shaped member capture the water closet flange therebetween. The opposing legs of the channel-shaped members preferably define a gap of about 8 millimeters therebetween. In this embodiment, the members are not of a channel-shaped cross section throughout their lengths, however. Rather, the apertured ends of the members are formed as flat extensions of the lower legs of the channel-shaped portions, preferably being formed with forked extremities.

The anchoring device of the invention is simple in construction, yet provides a connection which is far more secure than that of conventional systems attached to a water closet ring having an annular radial flange from which a portion has been broken away.

In another broad aspect the present invention may be considered to be a method of anchoring a toilet atop a water closet ring having an annular radial flange, a portion of which is broken away to define a gap in the flange. The method of the invention utilizes an anchoring device having a pair of arcuate members both with flat surfaces formed at the same diameter as the closet ring flange. At least one of the arcuate members extends in an arc over a distance greater than 180 degrees. The members both have a first set of ends hingedly joined together and a second set of apertured ends. At least one seating bolt is provided for use with the anchoring device.

According to the steps of the invention the second or apertured ends of the members are spread apart and the members are moved downwardly from above the annular radial flange of the closet ring to a position wherein the flat surfaces of the members are located below the flange. The second ends of the members are then brought together into overlapping relationship so that together they form a collar about the water closet ring with the flat surfaces of the members juxtaposed against the underside of the radial flange. The bolt provided is passed upwardly through a selected set of the ends of the members, through the gap in the flange and through a bolt opening in the base of the toilet. The apertured ends of the members are then secured together. The toilet is then clamped atop the radial flange with a retaining nut on the bolt provided.

The unbroken portion of the radial flange of the closet ring normally has at least one bolt opening therethrough. Preferably, the first set of ends of the members of the anchoring device are preferably hingedly joined together by an elongated bolt that serves both as a hinge pin and as a second seating bolt. When the method of reseating a toilet is practiced in its preferred embodiment, the second elongated bolt is passed upwardly the second set of ends of the members and through a bolt opening in the radial flange of the closet ring. A clamping nut is fastened on the second elongated bolt and is tightened down to secure the second set of ends of the members to the closet ring flange, as well as to each other.

The invention may be described with greater clarity and particularity by reference to the accompanying drawings.

DESCRIPTION OF THE EMBODIMENTS AND IMPLEMENTATION OF THE METHOD

Figure 1:
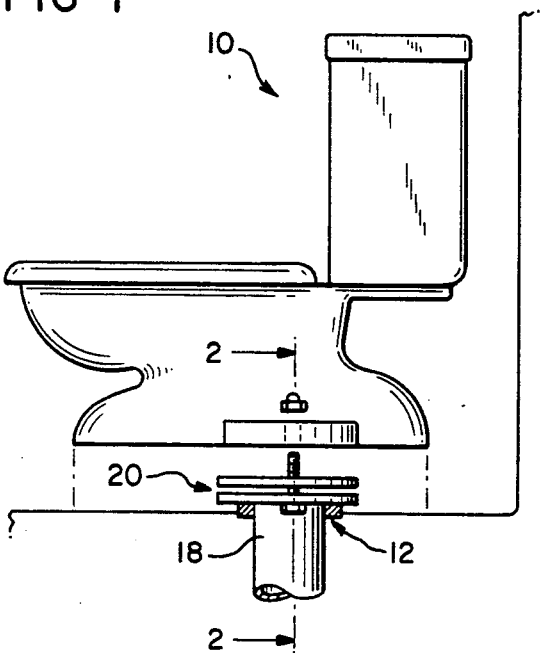
FIG. 1 is an elevational view illustrating the method of anchoring a toilet atop a broken water closet ring utilizing one embodiment of an anchoring device according to the invention.
Figure 3:
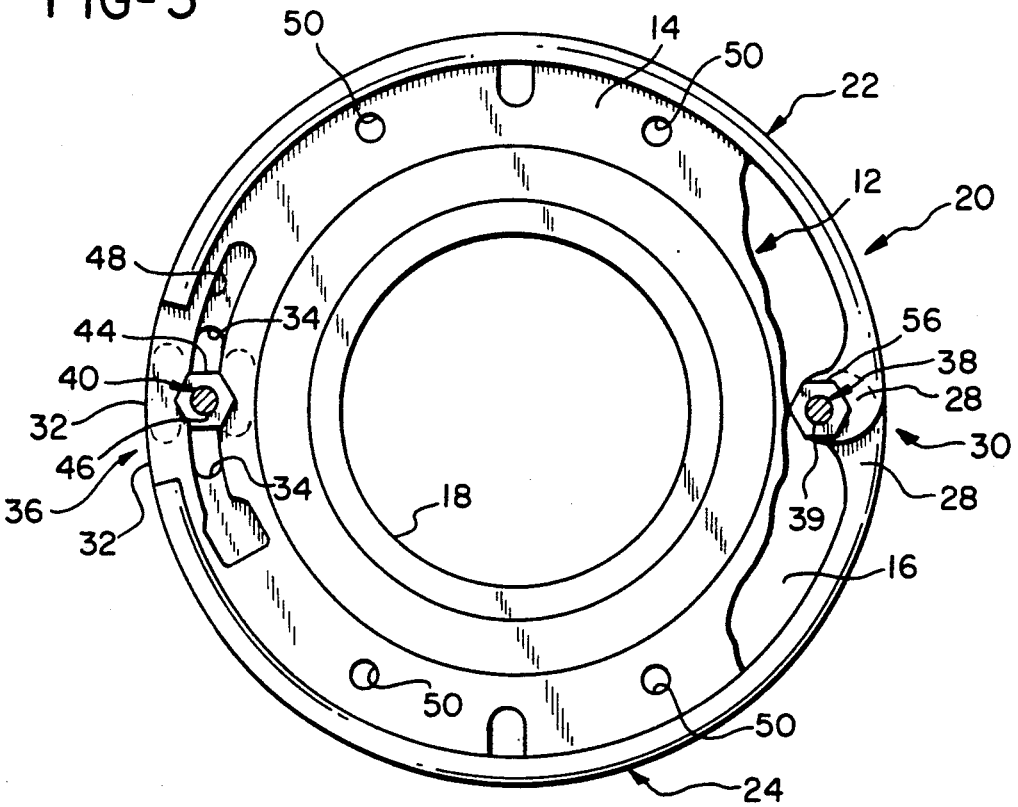
FIG. 3 is a top plan view taken along the lines 3—3 of FIG. 2.

FIG. 1 illustrates a toilet 10 which is to be reseated atop a water closet ring 12 having a circular, annular radial flange 14, a portion of which is partially broken away to define a gap 16 in the flange 14, as illustrated in FIG. 3. The water closet ring 12 is located atop a vertically extending waste line termination 18 at approximately floor level, as illustrated in FIG. 1.

An anchoring device 20 according to the invention is provided for reseating the toilet 10 atop the broken closet ring 12. The anchoring device 20 is comprised of a pair of arcuate members 22 and 24, illustrated in FIG. 4. Both of the members 22 and 24 have flat surfaces 26, and are each formed at the same diameter as the water closet flange 14. The member 22 is formed in an arc over a distance greater than 180 degrees. The members 22 and 24 have mutually hinged ends 28 which together form a first set 30 of vertically aligned ends. The members 22 and 24 also have opposite apertured ends 32, each having an opening 34 therein. In this way, when the arcuate members 22 and 24 are closed about the partially broken away water closet flange 14, the apertured ends 32 of the members 22 and 24 overlap each other to form a second set 36 of vertically aligned ends.

Figure 2:
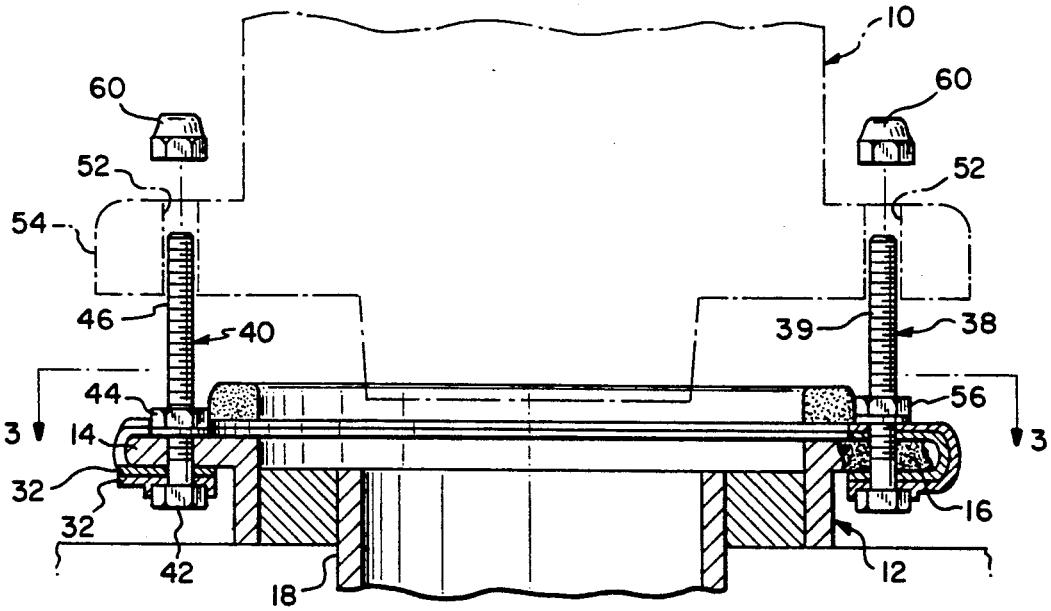
FIG. 2 is a sectional elevational detail taken along the lines 2—2 of FIG. 1.

The anchoring device also includes means for securing the apertured ends 32 together. At least one seating bolt 38 passes through at least one of the sets 30 or 36 of the vertically aligned ends 28 or 32 upwardly through the gap 16 in the water closet flange 14 as depicted in FIGS. 2 and 3. In this embodiment the function of securing the apertured ends 32 of the members 22 and 24 together is performed by the head 42 of a second seating bolt 40 and a clamping nut 44 threadably engaged on the shank 46 of the bolt 40.

Figure 4:
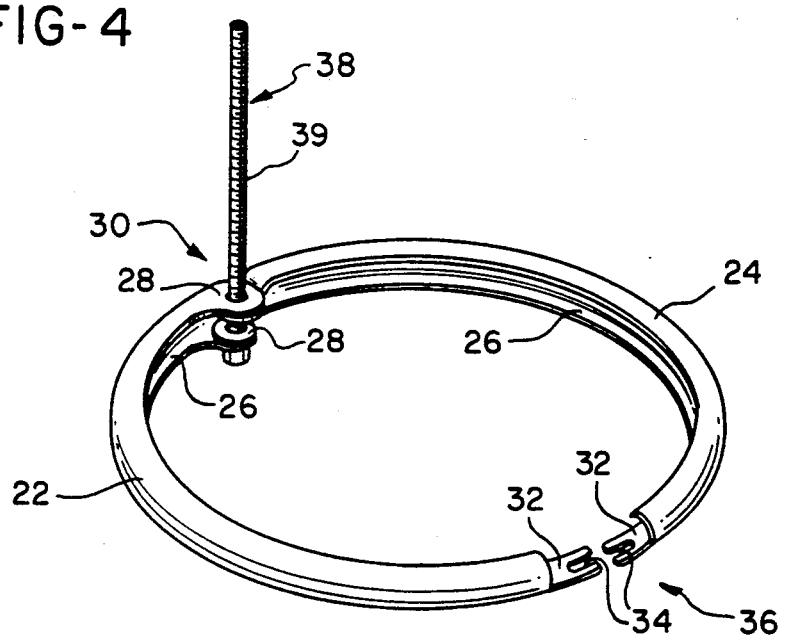
FIG. 4 is a perspective view of the anchoring device employed in FIGS. 1—3.

As illustrated in FIG. 4 the apertured ends 32 of the arcuate members 22 and 24 are both formed with forked extremities. That is, the extremities of the ends 32 each define a pair of arcuate, elongated fingers between which there is an open ended slot forming the aperture 34. The members 22 and 24 are both formed with a channel-shaped cross-sectional configuration as illustrated in FIG. 4. The interior surfaces 26 of the lowermost channel walls face upwardly and form the flat surfaces which are juxtaposed against the underside of the flange 14. The interior walls of the channel-shaped members 22 and 24 embrace the top and bottom edges of the flange 14 where they reside in contact therewith and the channel-shaped members 22 and 24 together surround the periphery of the flange 14.

At the hinged ends 28 the extremities of the channel-shaped members 22 and 24 are each formed with a pair of upper and lower, radially inwardly projecting tabs. The openings in the tabs at the hinged ends 28 of the members 22 and 24 are adapted to receive the elongated bolt 38 which serves both as a hinge pin for the first set 30 of the ends 28 of the members 22 and 24 and also as an anchor bolt for the water closet ring 12. The tabs at the ends 28 of the arcuate members 22 and 24 extend radially inwardly toward the center of the diameter of the water closet ring 12 a sufficient distance so that the vertically aligned circular openings therein which receive the elongated bolt 38 are the same distance from the central axis of the water closet ring 12 as are the slots 48 and openings 50 in the water closet ring flange 14. As a result, the elongated bolt 38 can be coaxially aligned with a selected opening 52 in the base 54 of the toilet 10.

To install the anchoring device of the invention from above the water closet ring 12 the toilet 10 is first removed from atop the water closet ring 12. The forked ends 32 of the arcuate members 22 and 24 are then spread apart from each other, the members 22 and 24 swing in arcs about the shank of the bolt 38. The members 22 and 24 are then moved downwardly until they reside in the same horizontal plane as the water closet ring flange 14. The members 22 and 24 are then rotated as unit together generally about the axis of the water closet ring 12 until the bolt 38 resides in radial alignment with the gap 16 defined by the missing portion of the water closet ring flange 14, as illustrated in FIG. 3. The forked ends 32 of the arcuate members 22 and 24 are then brought toward each other into overlapping relationship with the members 22 and 24 rotating about the bolt 38, so that together the members 22 and 24 form a collar about the water closet ring 12 with the interior upwardly facing flat surfaces 26 of the arcuate members 22 and 24 juxtaposed against the underside of the radial flange 14, except of course in the area of the gap 16 defined by the missing portion of the flange 14.

The forked or apertured ends 32 of the members 22 and 24 are then secured together by positioning the second seating bolt 40 beneath the overlapping apertured ends 32 of the members 22 and 24 and pushing the bolt shank 46 up through the space defined by the overlapping forked slots 34 and through one of the openings 50, or preferably the elongated slot 48 in the closet ring flange 14, as depicted in FIGS. 2 and 3. The clamping nut 44 is then threadably engaged on the shank 46 of the bolt 40 and tightened down against the upper surface of the water closet ring flange 14, as illustrated in FIG. 2. By tightening the clamping nut 44 the apertured ends 32 of the members 22 and 24 are clamped together and to the water closet ring flange 14 between the head 42 of the bolt 40 and the clamping nut 44. The ends 32 of the members 22 and 24 are thereby secured together and immobilized relative to each other and relative to the closet ring flange 14.

On the opposite side of the closet ring flange 14 the shank 39 of the elongated seating bolt 38 resides in coaxial alignment with an opening 52 in the base 54 of the toilet 10, since the openings in the tabs at the ends 28 are the same distance from the center of the water closet ring 12 as are the openings 50 and remaining slot 48 in the water closet ring 12. To further secure the arcuate members 22 and 24 to the water closet ring flange 14, another clamping nut 56 is preferably tightened down the shank 39 of the bolt 38 to bear against the uppermost tab of the end 28 of member 22 so as to compress the interior horizontally disposed surfaces of the members 22 and 24 against the upper and lower surfaces of the closet ring flange 14 adjacent the gap 16 therein.

As is evident from FIGS. 2 and 3, according to the method of the invention the bolt 38 passes upwardly through a selected set 30 of the ends 28 of the members 22 and 24 and through a bolt opening 52 in the toilet base 54. Retaining nuts 60 are then threadably engaged on the upwardly protruding tips of the shanks 39 and 46 of the bolts 38 and 40, respectively, and are tightened down in the usual manner. The retaining nuts 60 thereby clamp the toilet 10 atop the radial flange 14 of the water closet ring 12.

While in the implementation of the method depicted the set 30 of hinged ends 28 of the arcuate members 22 and 24 are positioned in the gap 16 formed by the missing portion of the closet ring 14, it is to be understood that the members 22 and 24 could be disposed in a position oriented 180 degrees from that depicted in FIG. 3 with the apertured ends 32 residing in mutually overlapping relationship in the region of the gap 16. If the anchoring device is employed in this manner, the bolt 38 would have to be temporarily withdrawn from the openings in the hinged ends 28 in order to allow the unbroken edge of the water closet ring flange 14 to be received between the sets of tabs at the ends 28 of the hinged members 22 and 24. Also, the implementation of the method of the invention would differ slightly from that depicted in FIG. 2 in that the clamping nut 56 would bear directly against the uppermost of the forked ends 32 of the members 22 and 24, rather than against the structure of the water closet ring flange 14, since the clamping nut 56 would be located in the area of the gap 16. In any event the invention can be implemented in either manner.

Figure 6:
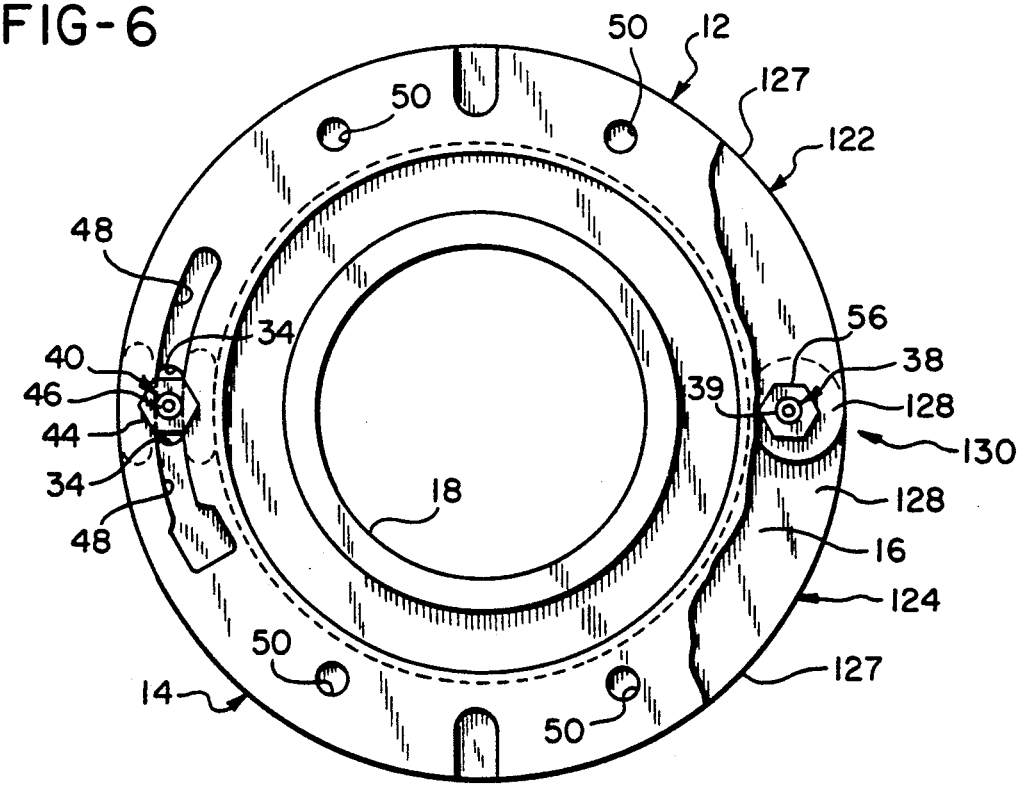
FIG. 6 is a top plan view showing the use of the embodiment of the anchoring device of FIG. 5 according to the invention.
Figure 5:
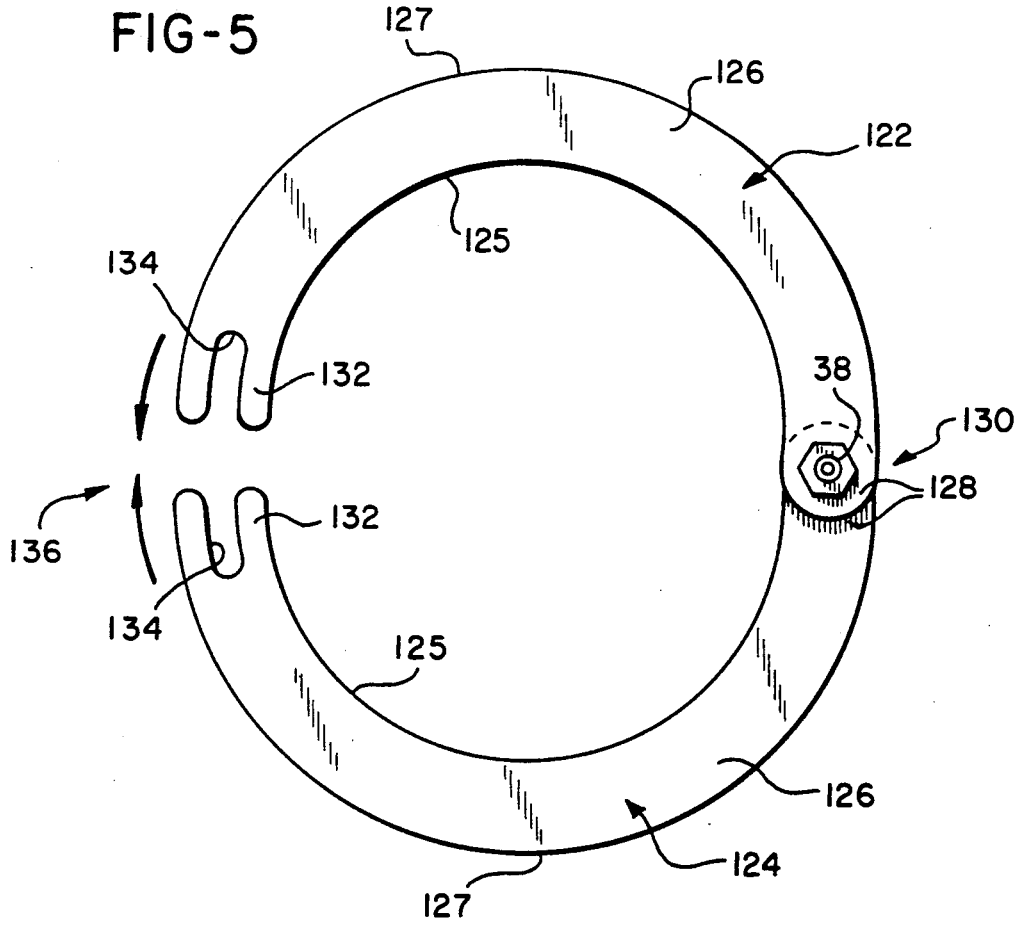
FIG. 5 is a top plan view of an alternative embodiment of an anchoring device according to the invention.

In the embodiment of FIGS. 1–4 the arcuate members 22 and 24 both have cross sections of channel-shaped configuration, whereby the members 22 and 24 together capture the peripheral edge of the radial flange 14 therewithin. While this has the advantage of more securely clamping the members 22 and 24 immovably against the structure of the broken water closet flange 14, it has the disadvantage of being applicable to water closet ring flanges of a particular thickness.

Where the thickness of the water closet ring flange 14 is such that it will not fit snugly within the channel-shaped confines of the members 22 and 24, it is preferable to employ an alternative embodiment of the invention depicted in FIGS. 5 and 6. As best illustrated in FIG. 5, the anchoring device of the invention may be formed of a pair of arcuate members 122 and 124, both formed of rigid, flat strips of sheet metal or hard plastic throughout. As with the embodiment of FIGS. 1–4, at least one of the members 122 and 124 is formed over an arc greater than a semi-circle of 180 degrees Both of the members 122 and 124 are formed at the same diameter as the water closet ring flange 14. In the embodiment of FIGS. 5 and 6 the interior edges 125 of the members 122 and 124 are preferably formed at a diameter of 145 millimeters, while the exterior edges 127 are preferably formed at a diameter of 180 millimeters. When the members 122 and 124 of the anchoring device are formed with these dimensions they can be used with most of the water closet rings which are presently commercially employed in plumbing installations.

The arcuate members 122 an 124 have a first set 130 of ends 128 which are hingedly joined together and a second set 136 of apertured ends 132. The ends 132 are both forked and each define an elongated arcuate slot 134 between a pair of radially separated fingers.

The arcuate members 122 and 124 both have flat, upwardly facing surfaces 126 which ar adapted to bear against the underside of the water closet ring flange 14 in the same manner as the flat, upwardly facing surfaces 26 of the channel-shaped members 22 and 24. In fact, the configuration of the embodiment of the anchoring device of FIGS. 5 and 6 is substantially the same as the configuration of the portions of the members 22 and 24 of FIGS. 1–4 which are formed by the flat, upwardly facing surfaces 26.

The embodiment of the anchoring device of FIGS. 5 and 6 is utilized in substantially the same manner as the embodiment of FIGS. 1–4. Specifically, to install the anchoring device of FIGS. 5 and 6 beneath a water closet ring flange 14 having a section broken away, the second or apertured ends 132 of the members 122 and 124 are spread apart. The members 122 and 124 are then moved downwardly from above the annular radial flange 14 to a position below it. The members 122 an 124 are then rotated as a unit together so that the elongated bolt 38, which serves as both a hinge pin and anchor bolt for the water closet ring 12, resides in registration with the gap 16 in the water closet ring 14, as illustrated in FIG. 6. The apertured ends 132 are then brought together in rotation about the hinge pin 38 into overlapping relationship, as illustrated in FIG. 6, such that the members 122 and 124 together form a collar about the water closet ring 12 with the flat upper surfaces 126 thereof juxtaposed against the underside of the radial flange 14, except of course in the area of the gap 16.

The bolt 46 is then passed upwardly from beneath the water closet ring flange 14 through the overlapping slots 134 of the ends 132 of the members 122 and 124 and through the slot 48 in the water closet ring flange 14. The clamping nut 44 is then tightened down against the top surface of the water closet ring flange 14, thereby securing and immobilizing the forked ends 132 of the members 122 and 124 together and to the water closet ring flange 14. The clamping nut 56 on the shank of the bolt 38 is likewise tightened to further immobilize the anchoring members 122 and 124 relative to each other. The further remaining steps in reseating of the toilet 10 are substantially the same as those depicted and described in association with the embodiment of FIGS. 1–4.

The anchoring device of the invention and the method of anchoring a toilet atop a water closet ring according to the invention provide a far more secure and permanent arrangement for reseating a toilet than has heretofore been possible with conventional systems. Nevertheless, the invention employs only members which are easily fabricated and which may be installed according to the method of the invention in a matter of just a few minutes and with only the conventional tools utilized in conventional plumbing work.

Undoubtedly, numerous variations and modifications of the invention will become readily apparent to those familiar with plumbing installations. Accordingly, the scope of the invention should not be construed as limited to the specific embodiments of the anchoring device and the specific methods of installation depicted and described herein, but rather is defined in the claims appended hereto.

I claim:

1. An anchoring device for use with a broken water closet ring having a cylindrical annular portion with a circular, annular flange having a peripheral edge extending radially therefrom, a missing portion of which defines a gap in said flange, comprising: a pair of arcuate members both having flat surfaces formed at the same diameter as said flange and at a greater diameter than said cylindrical annular portion of said water closet ring, at least one of said members being formed in a length greater than a semi-circle, said members both having a first end and a second end, connecting means for hingedly joining said first ends of said arcuate members together, whereby said members are positionable around said cylindrical annular portion of said closet ring with their flat surfaces located directly beneath said annular flange, means for securing said second ends of said members together, and at least a first bolt comprises one of said connecting means and said means for securing, wherein said first bolt extends upwardly from one of said sets of ends and through said gap in said flange.

2. An anchoring device according to claim 1 wherein said second ends are both formed with forked extremities.

3. An anchoring device according to claim 1 wherein said connecting means is comprised of said first bolt which serves both as a hinge pin for said first set of ends and also as an anchor bolt for said water closet ring.

4. An anchoring device according to claim 3 wherein said means for securing said second ends together is comprised of a second bolt that has a head and a shank that passes upwardly through said second set of ends of said members and said means for securing said second ends of said members together is further comprised of a clamping nut threadably engaged on said shank of said second bolt so as to clamp said second ends of said members between said annular flange and said head of said second bolt.

5. An anchoring device according to claim 1 wherein said members are both formed as flat metal strips.

6. An anchoring device according to claim 1 wherein said members are formed with a channel shaped cross sectional configuration and are adapted to encompass said peripheral edge of said flange.

7. A device for reseating a toilet atop a water closet ring having a cylindrical annular portion with an annular flange having a peripheral edge extending radially therefrom, a portion of which is partially broken away to define a gap in said flange, comprising: a pair of arcuate members having flat surfaces and at least one of said arcuate members is formed in an arc greater than 180 degrees and both of said arcuate members are formed at the same diameter as said water closet ring flange and at a greater diameter than said cylindrical annular portion of said water closet ring, said members having mutually hinged ends which together form a first set of vertically aligned ends and an opposite second set of ends, connecting means hingedly joining said first set of ends together, whereby when said arcuate members are disposed beneath said partially broken away water closet flange said second ends of said members are positionable to overlap each other in mutual vertical alignment, means for securing said second ends together, and at least a first seating bolt which comprises one of said connecting means and said means for securing, and said first seating bolt passes through one of said sets of said vertically aligned ends upwardly through said gap in said water closet flange.

8. A device according to clam 7 wherein said second ends are both formed with forked extremities having arcuate slots therein.

9. A device according to claim 7 wherein both said first and second sets of ends have openings therethrough and said connecting means is comprised of said first seating bolt which extends upwardly through said openings in said hinged ends of said members to serve as both a hinge pin for said first set of ends and also as an anchor bolt, and further comprising a second seating bolt that has a head and a shank that passes upwardly through said openings in said second set of vertically aligned ends, and said means for securing said second ends together is comprised of said second seating bolt head and a clamping nut threadably engaged on said shank of said second seating bolt, whereby said second seating bolt head and said clamping nut clamp said second set of ends of said members to said annular flange.

10. A device according to claim 7 wherein said members are formed as rigid flat strips of uniform thickness throughout.

11. A device according to claim 7 wherein said members both have cross sections with channel shaped peripheries, whereby said members together capture said peripheral edge of said radial flange therewithin.

12. A method of anchoring a toilet atop a water closet ring having a cylindrical annular portion with an annular flange extending radially outwardly therefrom, a portion of which is broken away to define a gap in said flange, utilizing an anchoring device having a pair of arcuate members both with flat surfaces formed at the same diameter as said flange and greater than the diameter of said cylindrical annular portion of said water closet ring and at least one of which is formed over an arc greater than 180 degrees, said members having first and second sets of ends, connecting means hingedly joining said first set of ends together, fastening means for securing said second set of ends together, and at least a first seating bolt having a means for retaining said first seating bolt on said members engageable thereon comprising one of said connecting means and said fastening means, the steps comprising: spreading said second set of ends of said members apart and moving said members downwardly from above said annular radial flange to a position wherein said flat surfaces of said members are located therebelow, bringing said second set of ends of said members together into overlapping relationship so that together said members form a collar about said water closet ring with said flat surfaces of said members juxtaposed against the underside of said radial flange, positioning said first seating bolt to extend upwardly through a selected set of said ends of said members and through said gap in said flange, securing said second set of ends of said members together with said fastening means, and clamping said toilet atop said radial flange with said retaining means engaged on said first seating bolt.

13. A method according to claim 12 wherein said radial flange has at least one bolt opening therethrough in an unbroken portion thereof and said connecting means is comprised of said first seating bolt, wherein said first seating bolt serves both as a hinge pin and as a seating bolt, and further characterized in that said fastening means is comprised of a second seating bolt and a clamping nut, and further comprising passing said second seating bolt up through said second set of ends of said members and through said bolt opening in said radial flange, and further characterized in that said step of securing said second set of ends is performed by fastening said clamping nut on said second seating bolt, and tightening said clamping nut down to secure said second set of ends of said members to said closet ring flange.

* * * * *